US009482075B2

(12) United States Patent
Smedstad

(10) Patent No.: US 9,482,075 B2
(45) Date of Patent: Nov. 1, 2016

(54) RETRIEVAL OF SUBSEA PRODUCTION AND PROCESSING EQUIPMENT

(75) Inventor: Eric Randall Smedstad, League City, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 14/423,664

(22) PCT Filed: Aug. 24, 2012

(86) PCT No.: PCT/US2012/052197

§ 371 (c)(1),
(2), (4) Date: Jul. 23, 2015

(87) PCT Pub. No.: WO2014/031122

PCT Pub. Date: Feb. 27, 2014

(65) Prior Publication Data

US 2015/0315878 A1 Nov. 5, 2015

(51) Int. Cl.
*E21B 41/00* (2006.01)

(52) U.S. Cl.
CPC ..... *E21B 41/0007* (2013.01)

(58) Field of Classification Search
CPC ..... E21B 41/0007
USPC ..... 166/351, 340, 365, 368
See application file for complete search history.

(56) References Cited

U.S. PATENT DOCUMENTS 4,903,628 A * 2/1990 Lansford ..... B63C 11/52 114/312
5,166,677 A * 11/1992 Schoenberg ..... E21B 33/0355 166/335
6,422,315 B1 7/2002 Dean
6,640,901 B1 11/2003 Appleford et al.
6,648,562 B1 * 11/2003 Calkins ..... F16L 41/04 137/318
6,783,107 B2 * 8/2004 Chatufale ..... F15B 1/24 251/54
6,851,481 B2 * 2/2005 Vinegar ..... E21B 17/003 166/374

(Continued)

FOREIGN PATENT DOCUMENTS

RU 2055218 C1 2/1996
RU 2367786 C1 9/2009

(Continued)

OTHER PUBLICATIONS

PCT International Search Report and Written Opinion dated May 21, 2013 for International Application no. PCT/US2012/052197.

(Continued)

*Primary Examiner* — Matthew R Buck
(74) *Attorney, Agent, or Firm* — Amerson Law Firm, PLLC

(57) ABSTRACT

Generally, the present disclosure is directed to systems that may be used to facilitate the retrieval and/or replacement of production and/or processing equipment that may be used for subsea oil and gas operations. In one illustrative embodiment, a system is disclosed that includes, among other things, subsea equipment (100) that is adapted to contain a first fluid while operating in a subsea environment (160), and an accumulator device (120*a*, 120*b*, 120*c*, 120*d*, 120*e*) that is in fluid communication with the subsea equipment (100), wherein a pressure boundary of the accumulator device (120*a*, 120*b*, 120*c*, 120*d*, 120*e*) is adapted to move in response to a pressure change on the subsea equipment (100) as the subsea equipment (100) is raised from the subsea environment (160).

33 Claims, 5 Drawing Sheets

(56) References Cited

U.S. PATENT DOCUMENTS

| | | | | |
|---|---|---|---|---|
| 7,108,006 | B2 * | 9/2006 | Armstrong | E21B 33/0355 137/14 |
| 7,137,450 | B2 * | 11/2006 | Johansen | E21B 33/0355 166/316 |
| 7,424,917 | B2 * | 9/2008 | Martin | B63C 11/52 166/319 |
| 7,628,207 | B2 * | 12/2009 | Leonardi | E21B 33/038 166/344 |
| 8,684,089 | B2 * | 4/2014 | Borhaug | E21B 7/124 137/15.04 |
| 8,833,465 | B2 * | 9/2014 | Kotrla | E21B 33/0355 166/358 |
| 9,097,267 | B2 * | 8/2015 | Eide | E21B 33/0355 |
| 9,169,714 | B2 * | 10/2015 | Edwards | E21B 33/076 |
| 2003/0170077 | A1 | 9/2003 | Herd et al. | |
| 2004/0094306 | A1 * | 5/2004 | Goode | E21B 7/124 166/339 |
| 2004/0168811 | A1 | 9/2004 | Shaw et al. | |
| 2005/0178560 | A1 | 8/2005 | Johansen et al. | |
| 2006/0210361 | A1 * | 9/2006 | Lamison | F16L 1/161 405/168.3 |
| 2010/0084588 | A1 | 4/2010 | Curtiss, III et al. | |
| 2010/0193194 | A1 | 8/2010 | Stoisits et al. | |
| 2010/0294383 | A1 * | 11/2010 | Melbo | E21B 33/0355 137/551 |
| 2011/0011593 | A1 * | 1/2011 | Borhaug | E21B 7/124 166/311 |
| 2011/0018630 | A1 | 1/2011 | Ma | |
| 2011/0114329 | A1 | 5/2011 | Emecheta et al. | |
| 2012/0241009 | A1 * | 9/2012 | Reid | E21B 33/0355 137/1 |
| 2012/0291688 | A1 * | 11/2012 | Dawes | B63C 11/00 114/312 |
| 2013/0327535 | A1 * | 12/2013 | Lamison | E21B 33/037 166/363 |

FOREIGN PATENT DOCUMENTS

| | | | |
|---|---|---|---|
| SU | 1002564 | A1 | 3/1983 |
| WO | 2011/048213 | A2 | 4/2011 |

OTHER PUBLICATIONS

PCT International Search Report and Written Opinion dated May 21, 2013 for International Application No. PCT/US2012/052203.

Search Report for Russian patent application No. 2015110164, filed on Aug. 24, 2012 (PCT effective).

* cited by examiner

RETRIEVAL OF SUBSEA PRODUCTION AND PROCESSING EQUIPMENT

BACKGROUND OF THE INVENTION

1. Field of the Invention

Generally, the present invention relates to equipment that is used for subsea oil and gas operations, and more particularly to systems that may be used to facilitate the retrieval and/or replacement of subsea oil and gas production and/or processing equipment.

2. Description of the Related Art

One of the most challenging activities associated with offshore oil and gas operations is the retrieval and/or replacement of equipment that may be positioned on or near the sea floor, such as subsea production and processing equipment and the like. As may be appreciated, subsea production and processing equipment, hereafter generally and collectively referred to as subsea equipment, may occasionally require routine maintenance or repair due to regular wear and tear, or due to the damage and/or failure of the subsea equipment that may be associated with unanticipated operational upsets or shutdowns, and the like. In such cases, operations must be performed to retrieve the subsea equipment from its location at the sea floor for repair, and to replace the subsea equipment so that production and/or processing operations may continue with substantially limited interruption.

In many applications, various cost and logistical design considerations may lead to configuring at least some subsea equipment components as part of one or more subsea production and/or processing equipment skid packages, generally referred to herein as subsea equipment packages or subsea equipment skid packages. For example, various mechanical equipment components, such as vessels, pumps, separators, compressors, and the like, may be combined in a common skid package with various interconnecting piping and flow control components, such as pipe, fittings, flanges, valves and the like. However, while skid packaging of subsea equipment generally provides many fabrication and handling benefits, it may present at least some challenges during the equipment retrieval process, as will be described below.

Depending on the size and complexity of a given subsea equipment skid package, the various equipment and piping components making up the skid package may contain many hundreds of gallons of hydrocarbons, or even more, during normal operation. In general, this volume of hydrocarbons in the subsea equipment skid package must be properly handled and/or contained during the equipment retrieval process so as to avoid an undesirable release of hydrocarbons to the surrounding subsea environment.

In many applications, subsea systems often operate in water depths of 5000 feet or greater, and under internal pressures in excess of 10,000 psi or more. It should be appreciated that while it may be technically feasible to shut in subsea equipment and retrieve it from those depths to the surface while maintaining the equipment under such high pressure, it can be difficult to safely handle and move the equipment package on and around an offshore platform or intervention vessel, as may be the case, while it is under such high pressure. Moreover, and depending on local regulatory requirements, it is may not be permissible to move or transport such equipment and/or equipment skid packages while under internal pressure.

Additionally, many subsea equipment skid packages may be assembled to adjacent subsea piping and/or other skid packages using mechanical connections, such as bolted flanged connections, and the like, using metallic seal rings. Oftentimes, disassembly of flanged connections in a subsea environment can be problematic, as the presence of seawater completely surrounding the flanged joint may hydraulically "lock" the flanges together. Specially designed vented couplers and/or vented metallic seal rings have been used in at least some prior art applications so as to facilitate the disassembly of certain pieces of subsea equipment. In operation, the venting action of these devices allows fluid to be displaced during the disassembly process, thus preventing hydraulic locking. However, the use of these prior art venting solutions generally results in at least some amount of leakage of seawater into the subsea equipment, and/or a detrimental leakage of produced hydrocarbons into the surrounding subsea environment, either of which can be problematic.

Yet another concern with subsea equipment is that problems can sometimes arise when flow through the equipment is stopped, for one reason or another, while the equipment is present in the subsea environment. For example, in some cases, flow through a given piece of subsea equipment may be intentionally stopped so that the equipment can be shut in and isolated for retrieval to the surface. In other cases, flow may inadvertently cease during inadvertent system shutdowns that occur as a result of operational upsets and/or equipment failures. Regardless of the reasons, when flow through the subsea equipment is stopped, hydrates and/or other undesirable hydrocarbon precipitates, such as asphaltenes, resins, paraffins, and the like, can sometimes form inside of the equipment. In such cases, the presence of any unwanted precipitates or hydrates can potentially foul the equipment and prevent a system restart after an inadvertent shut down, or they can complicate maintenance and/or repair efforts after the equipment has been retrieved to the surface. These issues must therefore generally be addressed during such times as when flow through the equipment ceases, such as by removal and/or neutralization of the constituents that may cause such problems.

In other cases, potentially damaging constituents, such as carbon dioxide ($CO_2$) or hydrogen sulfide ($H_2S$) and the like, may be present in solution in the liquid hydrocarbons that may be trapped inside of the equipment during shutdown. For example, hydrogen sulfide can potentially form sulfuric acid ($H_2SO_4$) in the presence of water, which may attack the materials of the some subsea equipment, particularly when flow through the equipment is stopped and the sulfuric acid remains in contact with the wetted parts of the equipment for an extended period of time. Furthermore, it is well known that carbon dioxide may also be present in the trapped hydrocarbons, and can sometimes come out of solution and combine with any produced water that may be present in the equipment so as to form carbonic acid ($H_2CO_3$), which can also be damaging the materials that make up the wetted parts of the equipment during prolonged exposure. As with the above-described problems associated with hydrates and hydrocarbon precipitates, remedial measures are sometimes required to address such issues that are related to the various constituents that can cause material damage to wetted components when flow through the equipment is stopped.

Accordingly, there is a need to develop systems and equipment configurations that may be used to overcome, or at least mitigate, one or more of the above-described problems that may be associated with the retrieval and/or replacement of subsea oil and gas equipment.

SUMMARY OF THE DISCLOSURE

The following presents a simplified summary of the present disclosure in order to provide a basic understanding of some aspects disclosed herein. This summary is not an exhaustive overview of the disclosure, nor is it intended to identify key or critical elements of the subject matter disclosed here. Its sole purpose is to present some concepts in a simplified form as a prelude to the more detailed description that is discussed later.

Generally, the present disclosure is directed to systems that may be used to facilitate the retrieval and/or replacement of production and/or processing equipment that may be used for subsea oil and gas operations. In one illustrative embodiment, a system is disclosed that includes, among other things, subsea equipment that is adapted to contain a first fluid while operating in a subsea environment, and an accumulator device that is in fluid communication with the subsea equipment, wherein a pressure boundary of the accumulator device is adapted to move in response to a pressure change on the subsea equipment as the subsea equipment is raised from the subsea environment.

Also disclosed herein is another illustrative system that includes subsea equipment that is adapted to contain a first fluid at a first fluid pressure while operating in a subsea environment, and an accumulator includes a first adjustable accumulator chamber that is in fluid communication with the subsea equipment and is adapted to receive at least a portion of the first fluid, a second adjustable accumulator chamber that is adapted to contain a second fluid. The accumulator device may further include a first movable piston positioned between the first adjustable accumulator chamber and the second adjustable accumulator chamber, the first movable piston being adapted to move in response to a pressure change on the subsea processing equipment as the subsea processing equipment is raised from the subsea environment, the movement adjusting a size of at least one of the first and second adjustable accumulator chambers. The system also includes, among other things, a first valve that is positioned to be in fluid communication with at least one of the first and second adjustable accumulator chambers, the first valve being adapted to reduce the first fluid pressure in response to said pressure change.

In another illustrative embodiment disclosed herein, a system includes, among other things, subsea equipment that is adapted to contain a first fluid while operating in a subsea environment, an accumulator device that is adapted to receive and store a quantity of a second fluid while the subsea equipment is positioned in the subsea environment, and a valve that is adapted to controllably inject at least a portion of the quantity of second fluid stored in the accumulator device into the subsea equipment.

BRIEF DESCRIPTION OF THE DRAWINGS

The disclosure may be understood by reference to the following description taken in conjunction with the accompanying drawings, in which like reference numerals identify like elements, and in which.

Figure 1A:
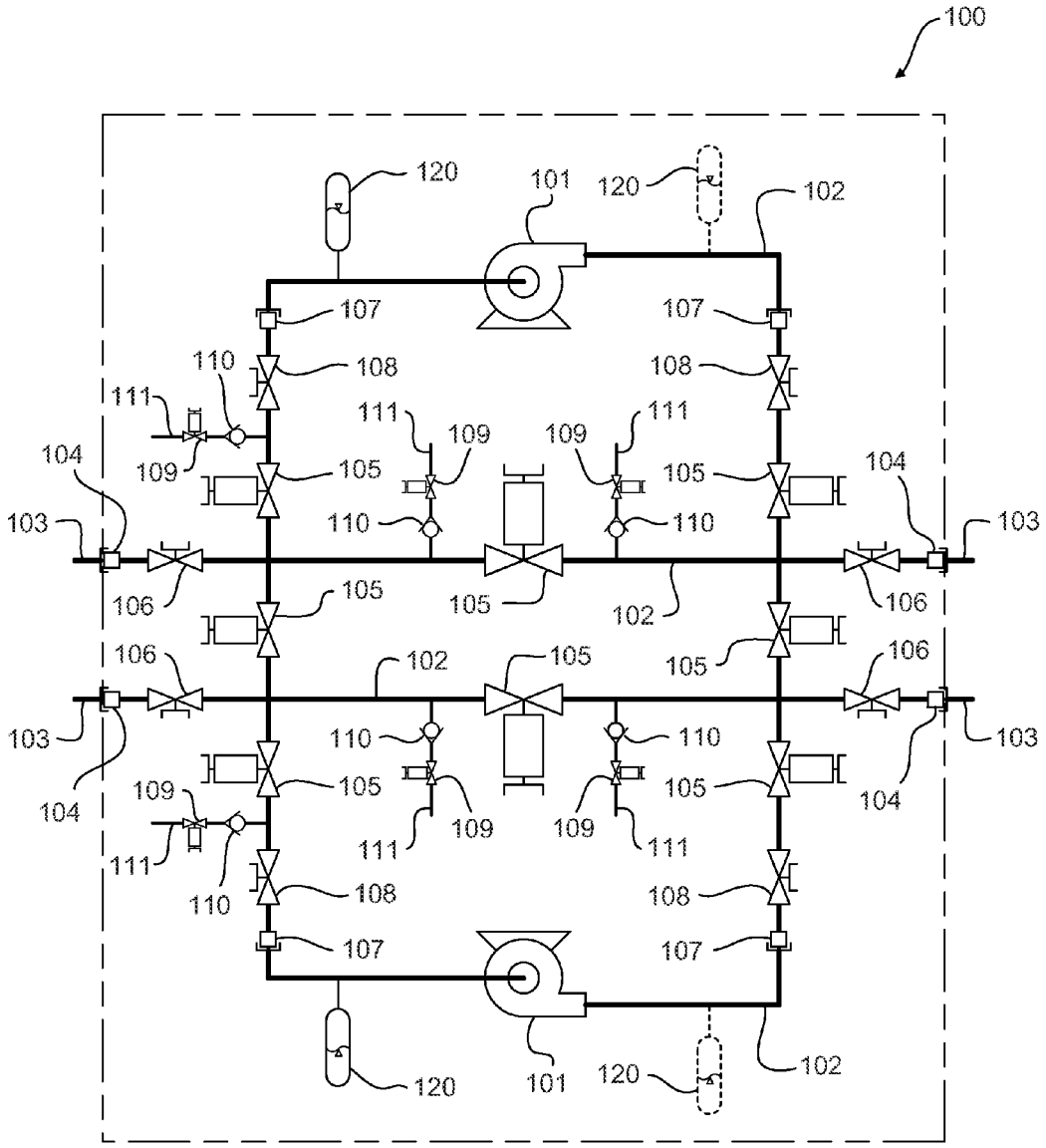
FIG. 1A is a schematic process flow diagram of an illustrative subsea equipment package in accordance with one illustrative embodiment of the present disclosure.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Various illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various structures and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Generally, the subject matter disclosed herein is directed to systems that may be used to facilitate retrieval and/or replacement of production and/or processing equipment that may be used in subsea oil and gas operations. In some illustrative embodiments of the present disclosure, an accumulator device may be positioned so that it is in fluid communication with a piece of subsea equipment. Furthermore, the accumulator device and the subsea equipment may both be included as part of a common subsea skid package, which may be retrieved from its position at or near the sea floor as may be necessary for equipment maintenance and/or repair. In certain embodiments, the accumulator device may be adapted to act as a pulsation dampener during normal operation of the subsea equipment so as to reduce or minimize the effects of undesirable operating conditions and/or pressure fluctuations on the subsea equipment. In other embodiments, the accumulator device may be adapted to act as a pressure compensator so as to overcome the hydraulic locking effect on any flanged joints connecting the subsea equipment or skid package to adjacent subsea piping and/or other subsea equipment, thereby facilitating separation and retrieval of the subsea equipment or skid package.

In further illustrative embodiments, an accumulator device that is adapted to act as a pressure relief device may be positioned in fluid communication with a piece of subsea equipment, and/or as part of a subsea equipment skid package. In such embodiments, the accumulator device may be adapted to lower the pressure of any hydrocarbons or other fluids that may be isolated within the subsea equipment during its retrieval from the sea floor, thereby facilitating the handling and/or transportation of the equipment after it has reached the surface. In yet other illustrative embodiments, the accumulator device may be further adapted to vent any expanding gases that may be released by the liquid hydrocarbons and/or other isolated fluids as the internal pressure on the subsea equipment is reduced during equipment retrieval.

In still other illustrative embodiments disclosed herein, an accumulator device that is adapted to store a quantity of equipment protection fluids may be positioned in fluid communication with a piece of subsea equipment, whereas in certain embodiments, both the accumulator device and the subsea equipment may be part of a common subsea equipment skid package. In certain embodiments, the accumulator device may be further adapted to release at least a portion of the quantity of the stored equipment protection fluids into the subsea equipment and/or skid package so as to thereby protect the equipment during retrieval to the surface, or in the event of an unanticipated equipment shutdown. In other embodiments, the accumulator device may be adapted so that the equipment protection fluids released therefrom sweeps at least a portion of any liquid hydrocarbons present in the subsea equipment out of the equipment prior to isolating the equipment and retrieving it to the surface.

Turning now to the above-listed figures, FIG. 1A is a schematic process flow diagram depicting a subsea equipment package 100 according to one illustrative embodiment of the present disclosure. As shown in FIG. 1A, the illustrative subsea equipment package 100 may be, for example, a subsea pump package that includes a pair of pumps 101. The pumps 101 may be used to pump liquid hydrocarbons and/or other produced fluids through skid flow lines 102, which may be removably attached via skid connections 104, e.g., flanged connections and the like, to subsea production lines 103. Depending on the design requirements of the subsea equipment package 100, the pumps 101 may be any one of several types that are commonly used in subsea oil and gas applications, such as helical axial pumps, electrical submersible pumps, and the like. In certain embodiments, the subsea equipment package 100 may also include skid isolation valves 106, which may be used to isolate the skid flow lines 102 from the subsea production lines 103 so that the subsea equipment package 100 can be separated at the skid connections 104 prior to retrieval to the surface. In particular embodiments, each of the skid isolation valves 106 may be manually operable, and furthermore may have a mechanical override for operation via a remotely operated subsea vehicle (ROV) (not shown).

In at least some embodiments, the subsea equipment package 100 may also include a plurality of control valves 105, the quantity and positioning of which may vary depending on the overall design parameters of the subsea equipment package 100, such as the quantity of pumps 101, the desired flow scheme, and the like. The control valves 105 may be, for example, hydraulically operated and/or automatically controlled, and may also have a mechanical ROV override. The subsea equipment package 100 may also include equipment isolation valves 108, which in some embodiments may be used to isolate the subsea equipment, i.e., the pumps 101 shown in the depicted example, as may be required. Additionally, equipment connections 107, such as flanged connections and the like, may in turn be used to removably attach the pumps 101 to the remainder of the subsea equipment package 100.

The subsea equipment package 100 may also include, among other things, chemical injection lines 111, which may be positioned at one or more strategic locations throughout the subsea equipment package 100. Depending on the type of equipment included on the subsea equipment package 100, the chemical injection lines may be used to inject any one or more of a variety of different chemicals into the package 100 during equipment operation, either automatically or on command. For example, the injection lines 111 may be used to introduce various flow assurance chemicals into the subsea equipment package 100 so as to avoid, or at least minimize, the formation of hydrates or undesirable hydrocarbon precipitates, such as asphaltenes, resins, paraffins, and the like. As used herein and in the claims, the term "flow assurance chemicals" should be understood to mean any type of chemical that may be utilized in an effort to assist with or insure flow of hydrocarbon materials through at least some portion of the subsea equipment package 100 and/or the flow lines 103. Illustrative examples of such flow assurance chemicals includes, but is not necessarily be limited to, liquids such as diesel oil, xylene, methanol (MeOH), ethylene glycol (glycol or MEG), and low dosage hydrate inhibitors (LDHI) such as anti-agglomerates and kinetic inhibitors. The injection of a given flow assurance chemical from each chemical injection line 111 may be controlled via an appropriately designed chemical injection control valve 109, which may be hydraulically operated and/or automatically controlled, as well as a check valve 110, which may be adapted to prevent the back-flow of hydrocarbons and/or other produced fluids into the chemical injection lines 111.

In other embodiments, the chemical injection lines 111 may also be used to introduce various other material protection chemicals into the subsea equipment package so as to neutralize, or at least substantially reduce, the potential material-damaging effects that may be caused by the presence of unfavorable constituents in the produced hydrocarbons, such as hydrogen sulfide and/or carbon dioxide and the like. As noted previously, such unfavorable constituents may tend to form acids in the presence of water, and as such the term "material protection chemicals" should be understood to mean any type of chemical that may be employed in an effort to substantially prevent or reduce the formation of acids in the liquids that may be trapped inside of the subsea equipment package 100, or to at least partially neutralize any acids that may be formed. Some illustrative examples of such material protection chemicals includes but is not necessarily limited to high pH liquids, such as sodium hydroxide (NaOH) and the like, which may act to neutralized any acids that do form in the subsea equipment package 100.

As shown in FIG. 1A, the subsea equipment package 100 may also include one or more accumulator devices 120, which, as previously noted, may be adapted to perform one or more of several different functions. For example, an accumulator device 120 may be adapted to act as: 1) a pulsation dampener during equipment operation; 2) a pressure compensator during equipment separation and retrieval; 3) a pressure relief device during equipment retrieval; and/or 4) a venting device during equipment retrieval, as will be further described with respect to FIGS. 1B-1F below. Additionally, the accumulator devices 120 may be positioned to be in fluid communication with a piece of subsea equipment, i.e., a pump 101. In certain embodiments, and depending on the specific design and layout criteria of the subsea equipment package 100, the accumulator device 120 may be positioned on the suction side, i.e., upstream, of the pump 101. In other illustrative embodiments, an accumulator device 120 may be positioned on the discharge side, i.e., downstream, of the pump 101 (as indicated by dashed lines in FIG. 1A), and which may be used either alternatively to or in addition to the accumulator device 120 that is shown in FIG. 1A as being positioned on the suction side of the pump 101.

It should be appreciated that the specific layout of the subsea equipment package 100 shown in FIG. 1A, and the quantity and type of equipment, i.e., pumps 101, included therein are illustrative only, as other layouts utilizing different types and/or quantities of subsea equipment may also be used. For example, in some embodiments, the layout of the subsea equipment package 100 may be adjusted so as to include only one pump 101, whereas in other embodiments the package 100 may include three or more pumps. In still other embodiments, the subsea equipment package 100 may include, additionally or alternatively, other types of subsea equipment, such as separator(s), knockout drum(s), compressor(s), flow meter(s), flow conditioner(s), and the like. Furthermore, it should also be appreciated that any illustrative embodiments of the subsea equipment package 100 disclosed herein are not limited to any certain types of applications, but may be associated with subsea production or processing operations, as may be the case depending on the specific application requirements.

Figure 1B:
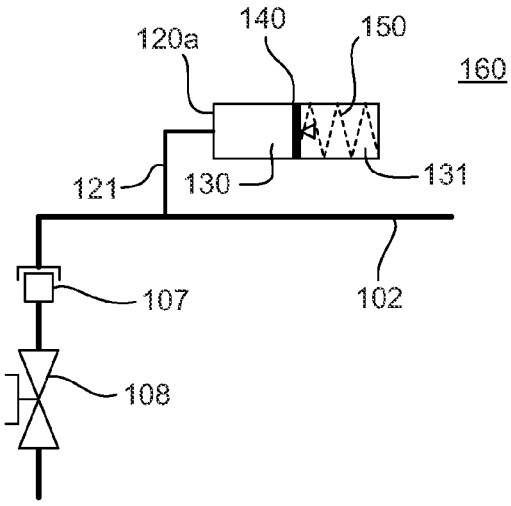
FIGS. 1B-1G are schematic process flow diagrams of various illustrative accumulator devices that may be used in conjunction with the subsea equipment package of FIG. 1A in accordance with some illustrative embodiments disclosed herein.

FIG. 1B schematically depicts one exemplary configuration of an accumulator device 120*a*, which may be representative of one or more of the accumulator devices 120 shown in FIG. 1A. In certain embodiments, the accumulator device 120*a* may function as pulsation dampener during the normal operation of the subsea equipment package 100, and/or as a pressure compensator during the separation and retrieval of the package 100. As shown in FIG. 1B, the accumulator device 120*a* may be in fluid communication, via connection line 121, with a skid flow line 102, and thereby in fluid communication with the various equipment on the subsea equipment package 100, e.g., the pumps 101 (see, FIG. 1A). In certain illustrative embodiments, the accumulator device 120*a* may be configured as a piston-type accumulator, wherein a movable piston 140 separates a first adjustable accumulator chamber 130 from a second adjustable accumulator chamber 131, and which acts as a pressure boundary that moves in response to pressure changes within either or both of the two adjustable accumulator chambers 131, 132. It should be appreciated, however, that the accumulator device 120*a* may be configured as a different type of accumulator, such as bladder-type accumulator or diaphragm-type accumulator, and the like. For example, the bladder or diaphragm of such devices may similarly act as a pressure boundary that separates adjustably sized chambers, and which is movable under pressure changes during the operation of the accumulator.

As noted above, the accumulator device 120*a* is in fluid communication with the skid flow line 102 via connection line 121, and as such, the first adjustable accumulator chamber 130 may contain hydrocarbons and/or other produced fluids that are being handled by the subsea equipment package 100. In at least some illustrative embodiments, the second adjustable accumulator chamber 131 may be pre-charged prior to deployment of the subsea equipment package 100 into the subsea environment with a compressible fluid, e.g., a gas such as nitrogen or helium and the like, or a compressible liquid such as glycerin or silicon oil and the like. Depending on the various system design parameters of the subsea equipment package 100, such as internal pressure, water depth, and the like, the pre-charge pressure in the second adjustable accumulator chamber 131 may be adjusted such that the movement of the piston 140 against the compressible fluid contained in the second adjustable accumulator chamber 131 provides a spring-like behavior. Accordingly, the accumulator device 120*a* may thereby act to dampen the effects of any pressure fluctuations that may occur in the skid flow lines 102 during operation of the subsea equipment package 100. Furthermore, in at least some embodiments, the accumulator device 120*a* may also include a biasing spring 150 positioned in the second adjustable accumulator chamber 131 and in contact with the piston 140, which may be used to further control the damping factor of the accumulator device 120*a*.

In other embodiments, the accumulator device 120*a* shown in FIG. 1B may be adapted to function as a pressure compensator so as to allow the disassembly of the connections 104 (see, FIG. 1A) during separation of the subsea equipment package 100 from the adjacent production lines 103. As previously noted, flanged connections that are used in subsea applications, such as the connections 104, are generally completely surrounded by seawater. As may be understood by those of ordinary skill, the surrounding seawater, which is substantially incompressible, may therefore act to hydraulically "lock" the flanged joint together. In at least some prior art applications, the flanged joint hydraulic locking problem has been addressed by use of special vented couplers and/or vented metallic seal rings, which provide for fluid communication between the seal ring grooves and the surrounding seawater environment, thus allowing the slight vacuum that is needed for flange disassembly. As previously noted, however, the use of these prior art solutions generally results in at least some detrimental ingress of seawater into the equipment, and/or a detrimental leakage of produced hydrocarbons into the subsea environment. On the other hand, when the accumulator 120*a* of FIG. 1B is in fluid communication with the connections 104, the spring-like effect of the piston 140 acting on the compressible fluid in the second adjustable accumulator chamber 131 may provide the degree of compressibility necessary to "unlock" the flanges that make up the connection 104, and substantially without permitting either the ingress of seawater into the subsea equipment package 100, or leakage of hydrocarbons into the subsea environment 160.

As may be appreciated by those of ordinary skill, the hydrocarbons that are processed by the subsea equipment package 100 are typically produced and handled in a liquid state, and maintained at very high pressures, such as in excess of 10,000 psi. These produced hydrocarbons usually contain a substantial quantity of short-chain hydrocarbons that would generally be in a gaseous state at pressures closer to ambient, but which are held in a liquid state under the high operating pressures of the subsea equipment package 100. In many cases, the gas-to-oil ratio (GOR) of hydrocarbons that are produced from subsea wells may be in the range of 250:1 to 500:1 or even greater, such as a GOR of 1000:1 or more. Accordingly, as the hydrostatic (i.e., external) pressure of the subsea environment 160 on the subsea equipment package 100 is reduced during retrieval of the package 100, some amount of the gas that is contained in the produced liquid hydrocarbons may expand out of the liquid.

In certain illustrative embodiments, the accumulator device 120*a* of FIG. 1B may be adapted to allow for some expansion of the gas contained in the liquid hydrocarbons during the retrieval of the subsea equipment package 100 from its subsea environment to the surface. For example, the accumulator device 120*a* may be positioned at or near a high point on the subsea equipment package 100 and sized so that the first adjustable accumulator chamber 130 can contain a certain quantity of the expanded gas.

Figure 1C:
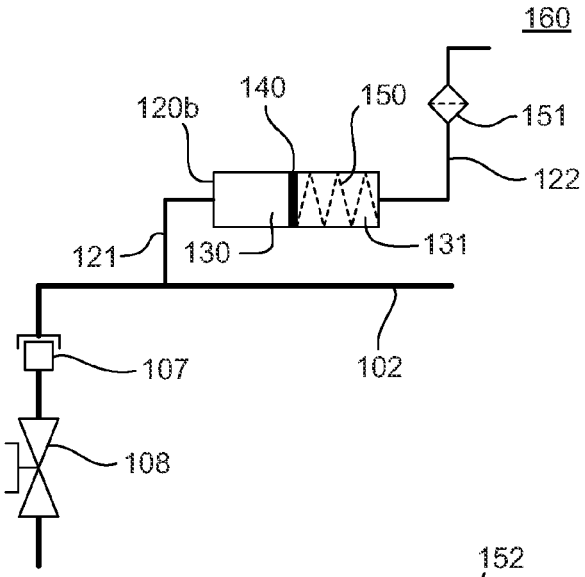

FIG. 1C schematically depicts an exemplary accumulator device 120*b*, which may be representative of a further illustrative embodiment of any one or more of the accumulator devices 120 shown FIG. 1A, and which may also be adapted to operate as a pulsation dampener, a pressure compensator, and/or a gas buster, as previously described. As with the exemplary accumulator device 120*a* illustrated in FIG. 1B, the accumulator device 120*b* of FIG. 1C may be in fluid communication with the skid flow line 102 via the connection line 121. Additionally, the accumulator device 120*b* may include a movable piston 140 that separates the accumulator device 120*b* into a first adjustable accumulator chamber 130 containing liquid hydrocarbons and/or other produced liquids and a second adjustable accumulator chamber 131. However, unlike the accumulator device 120*a* of FIG. 1B, the second adjustable accumulator chamber 131 of the accumulator device 120*b* shown in FIG. 1C may be open to, i.e., biased to, the subsea environment 160 via the biasing line 122, such that the pressure in the second adjustable accumulator chamber 131 is substantially the same as hydrostatic pressure of the subsea environment 160 at the depth where the subsea equipment package 100 may be positioned at any given time. In at least some embodiments, a filter 151 may be positioned in the biasing line 122 so as to substantially prevent the ingress of marine life and/or other subsea contaminants, thereby substantially avoiding any fouling of the accumulator device 120*b* during operation.

Depending on the various design and operating parameters of the subsea equipment package, such as internal pressure, water depth, and the like, the accumulator device 120*b*, may also include a biasing spring 150 that is positioned in the second adjustable accumulator chamber 131 and contacts the piston 140. In certain illustrative embodiments, the damping factor of the accumulator device 120*b* may be tuned by selecting the biasing spring 150 with an appropriate spring rate, and/or adjusting the size of any flow orifice (not shown) between the second adjustable accumulator chamber 131 and the biasing line 122.

In operation, the accumulator device 120*b* shown in FIG. 1C may function as a pulsation dampener and/or a pressure compensator in a substantially similar fashion as the illustrative embodiment shown in FIG. 1B and described above. However, since second adjustable accumulator chamber 131 is biased to the hydrostatic pressure of the subsea environment 160, the pressure in the second chamber 131 will be gradually reduced during retrieval of the subsea equipment package 100 to the surface. Furthermore, an additional amount of expanded gas may be allowed to enter the first adjustable accumulator chamber 130 as the subsea equipment package 100 is being raised.

Figure 1D:
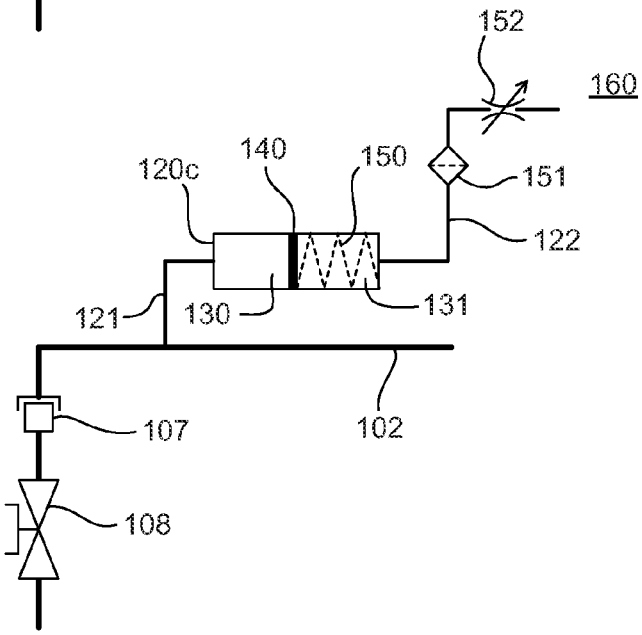

FIG. 1D schematically depicts a further illustrative accumulator device 120*c* that is substantially similar to the accumulator device 120*b* shown in FIG. 1C, wherein however the accumulator device 120*c* also includes an adjustable control valve 152, such as a needle choke valve and the like, which has been positioned in the biasing line 122 so as to control the flow of seawater into and/or out of the second adjustable accumulator chamber 131. In certain illustrative embodiments, the adjustable control valve 152 may be adjusted so as to control the damping factor of the accumulator device 120*c* during the normal operation of the subsea equipment package 100, together with an orifice (not shown) between the second adjustable accumulator chamber 131 and the biasing line 122 and/or a biasing spring 150, when those elements may be provided.

In other embodiments, the adjustable control valve 152 may be further adjusted and/or set during the retrieval operation of the subsea equipment package 100 such that flow through the biasing line 122 is substantially prevented until the package 100 has been raised to a certain predetermined water depth, and/or the hydrostatic pressure of the subsea environment 160 has been reduced to a predetermined level. In this way, the expansion of any hydrocarbon gases that may be present within the liquid hydrocarbons contained in the subsea equipment package 100 may be substantially restricted during an initial phase of the equipment retrieval operation, which may be more conducive to at least some gas venting operations, which will be further described with respect to FIG. 1E below.

Figure 1E:
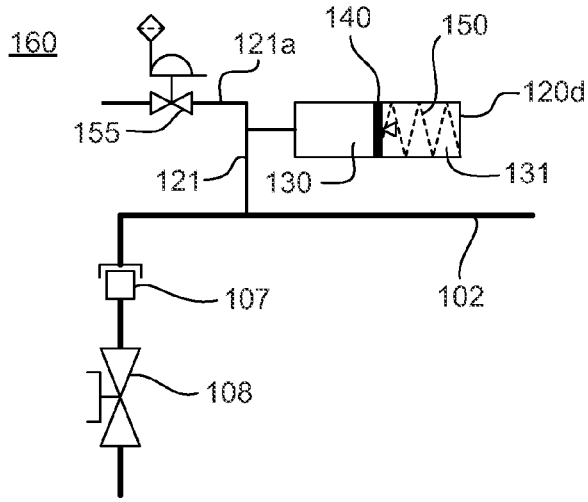

FIG. 1E schematically depicts yet another exemplary accumulator device 120*d* that may be representative of a further illustrative embodiment of one or more of the accumulator devices 120 shown in FIG. 1A and described above. In certain embodiments, the accumulator device 120*d* may be adapted to function as one or more of a pulsation dampener and a pressure compensator as previously described. Furthermore, the accumulator device 120*d* may be configured in a substantially similar fashion as the accumulator device 120*a* shown in FIG. 1B, wherein however it may also include a pressure relief valve 155 that is in fluid communication with the connection line 121, the first adjustable accumulator chamber 130, and the skid flow line 102 by way of a relief line 121*a*, as shown in FIG. 1E.

In some embodiments, the relief valve 155 may be adapted to allow any gaseous hydrocarbons that may expand out of the liquid hydrocarbons contained in the subsea equipment package 100 to be vented into the subsea environment 160 as the package 100 is being raised to the surface. Furthermore, the relief valve 155 may be configured such that venting of expanding gases may only occur when the internal pressure in the subsea equipment package 100 is greater than the hydrostatic pressure of the subsea environment 160 by a predetermined threshold amount, e.g., so that gas venting does not occur until the package 100 has been raised to predetermined water depth. Additionally, the rate at which the expanding gas is vented from the accumulator 120*d* may be carefully controlled in such a manner as to substantially prevent the inadvertent carryover of liquid hydrocarbons during the venting process, thereby substantially avoiding a potentially detrimental spillage of liquid hydrocarbons into the subsea environment 160.

In other illustrative embodiments, the accumulator device 120*d* may configured in a substantially similar fashion to one of the accumulator devices 120*b* or 120*c* as shown in FIGS. 1C and 1D, respectively, such that the second adjustable accumulator chamber 131 of the accumulator device 120*d* is biased to the subsea environment 160. In this way, additional control may be provided over the pressure at which the venting of expanding gaseous hydrocarbons from the accumulator device 120*d* may commence, as well as the rate at which the gases are vented.

Figure 1F:
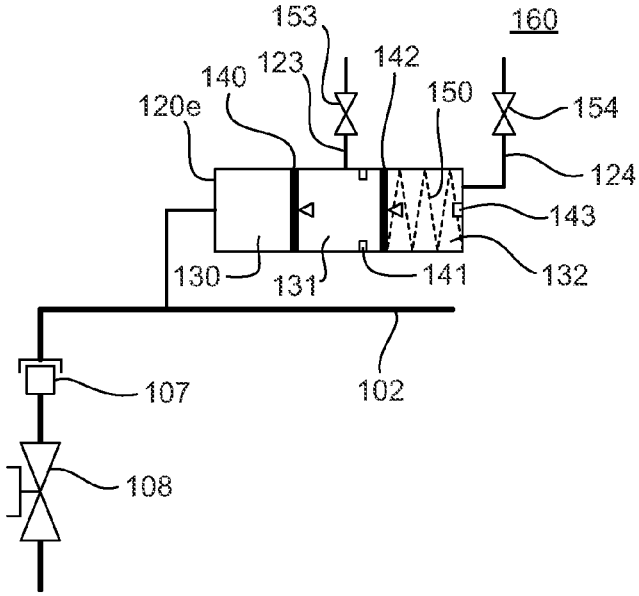

FIG. 1F schematically illustrates yet another exemplary accumulator device 120*e*, which may also be representative of further illustrative embodiments of one or more of the accumulator devices 120 shown in FIG. 1A. As shown in FIG. 1F, the accumulator device 120*e* may include, among other things, a first adjustable accumulator chamber 130, a second adjustable accumulator chamber 131, and a third adjustable accumulator chamber 132. Additionally, the accumulator device 120*e* may also include a pre-charge valve 153 that is connected to the accumulator device 120*e* via a pre-charge line 123 and a retrieval valve 154 that is connected to the accumulator device 120*e* via a retrieval line 124. Furthermore, a connection line 121 may provide fluid communication between the skid flow line 102 and the first adjustable accumulator chamber 130, which may therefore contain a portion of the hydrocarbons and/or other produced liquids that are handled by the subsea equipment package 100.

In some illustrative embodiments, the first adjustable accumulator chamber 130 of the accumulator device 120*e* may be separated from the second adjustable accumulator chamber 131 by a first movable piston 140. Furthermore, in certain embodiments, the second adjustable accumulator chamber 131 may be pre-charged prior to deployment of the subsea equipment package 100 into the subsea environment with a compressible fluid, e.g., a gas or a compressible liquid as previously described, and which may be isolated in the second adjustable accumulator chamber 131 by the pre-charge valve 153. Furthermore, as described above with respect to the accumulator device 120*a* shown in FIG. 1B, the pre-charge pressure in the second adjustable accumulator chamber 131 may be adjusted such that the movement of the first movable piston 140 against the compressible fluid contained in the second adjustable accumulator chamber 131 provides a spring-like behavior. It should therefore be appreciated that the accumulator device 120*e* may be adapted to function as a pulsation dampener and/or a pressure compensator, as described above.

As illustrated in FIG. 1F, the third adjustable accumulator chamber 132 may be separated from the second adjustable accumulator chamber 131 by a second movable piston 142. In certain embodiments, the third adjustable accumulator chamber 132 may also be pre-charged prior to deployment with a substantially incompressible liquid, such as water or seawater, and which may be isolated in the third adjustable accumulator chamber 132 by way of the retrieval valve 154. In at least one embodiment, the substantially incompressible pre-charge liquid may also include a suitable hydrate inhibitor, such as MeOH or MEG and the like, so as to reduce the likelihood that hydrates may form during operation in the event any hydrocarbons inadvertently bypass the seals on the first and second movable pistons 140 and 142. In other illustrative embodiments, the third adjustable accumulator chamber 132 may not be pre-charged as described above, and instead the retrieval valve 154 may be left open during deployment of the subsea equipment package 100 to it subsea location so that, during operation, the third adjustable accumulator chamber 132 is biased to the hydrostatic pressure of the subsea environment 160, as previously described with respect to the accumulator devices 120*b* and 120*c* of FIGS. 1C and 1D, respectively. In certain embodiments, a biasing spring 150 may also be positioned in the third adjustable accumulator chamber 132 such that it is in contact with the second movable piston 142, thereby providing an additional degree of control over the effective damping factor of the accumulator device 120*e* during the various operational and/or retrieval phases of the subsea equipment package 100.

In some embodiments, piston stops 141 may be positioned inside of the accumulator device 120*e* and between the first and second movable pistons 140 and 142 so as to thereby limit travel of the first movable piston 140 toward the third adjustable accumulator chamber 132, and to limit travel of the second movable piston 142 toward the second adjustable accumulator chamber 131. Additionally, piston stop 143 may be positioned inside of the accumulator device 120*e* on an opposite of the second movable piston 142 from the first movable piston 140 so as to thereby limit travel of the second movable piston 142 away from the first movable piston 140.

Figure 1G:
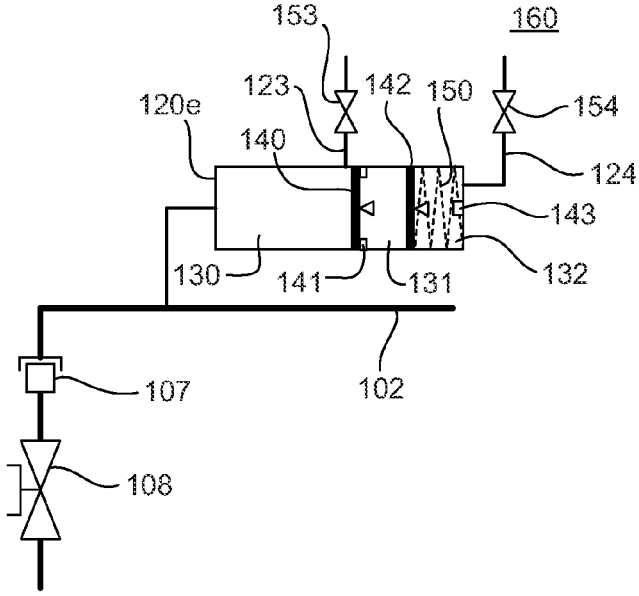

In certain illustrative embodiments, the accumulator device 120*e* may also be operated so as to function as a pressure relief device during retrieval of the subsea equipment package 100, and so that expanding gaseous hydrocarbons may be safely vented to the subsea environment 160. In those embodiments wherein the third adjustable accumulator chamber 132 has been pre-charged prior to deployment of the subsea equipment package 100, the retrieval valve 154 may be opened so that at least some of the pre-charged incompressible fluid initially contained therein can be discharged through the retrieval line 124 and into the subsea environment 160, thereby allowing the second movable piston 142 to move toward the piston stop 143. Movement of the second movable piston 142 in this manner also allows the first movable piston 140 to move in the same direction, i.e., toward the piston stops 141. In some illustrative embodiments, movement of the first and second movable pistons 140 and 142 may continue at least until the first movable piston 140 moves past the opening of the pre-charge line 123, and may further continue until the first movable piston 140 stops after coming into contact with the piston stops 141. FIG. 1G schematically illustrates the accumulator device 120*e* after the above-described operations, i.e., after the second movable piston 142 has moved toward the piston stop 143 and the second movable piston 140 has moved into contact with the piston stops 141.

It should be appreciated that as the first movable piston 140 moves toward the piston stops 141, the size of the first adjustable accumulator chamber 130 increases. Furthermore, since the first adjustable accumulator chamber 130 is in fluid communication with the subsea equipment package 100 via the connection line 121, the pressure within the package 100 will also drop, thereby permitting at least a portion of the gas present in the liquid hydrocarbons contained in the package 100 to expand out of the liquid phase. After the first movable piston has moved at least past the opening to the pre-charge line 123, the pre-charge valve 153 may be opened so that the expanding gaseous hydrocarbons may be controllably vented to the subsea environment 160.

In at least some embodiments, and depending on the initial pre-charge pressure of the incompressible fluid contained within the third adjustable accumulator chamber 132, the retrieval valve 154 may be opened after the subsea equipment package 100 has been isolated using the isolation valves 106 and disconnected from the production flow lines 103 at the connections 104 (see, FIG. 1A), but before the package 100 is raised from its position near the sea floor. In such embodiments, and depending on the water depth and the shut-in pressure on the subsea equipment package 100, the pre-charge valve 153 may also be opened while the package 100 is in its position near the sea floor so as to vent at least a portion of the expanding gases coming out of the liquid hydrocarbons. In other embodiments, the hydrostatic pressure of the subsea environment 160 near the sea floor may be too high to permit all of the gaseous hydrocarbons that may be present in the liquid phase to fully expand, in which case the subsea equipment package 100 may be raised toward the surface so that the hydrostatic pressure is reduced, thereby allowing more gases to expand and be vented through the pre-charge line 123 and pre-charge valve 153 as the package 100 is raised. In further embodiments, the subsea equipment package 100 may be raised at least part of the way to the surface, i.e., to a shallower water depth and a lower hydrostatic pressure, before the pre-charge valve 153 is opened and the venting of expanding gas is commenced.

It should be understood that the above described venting sequences are similarly applicable to those embodiments of the present disclosure wherein the third adjustable accumulator chamber 132 was not initially pre-charged with an incompressible fluid, but was instead simply biased to the subsea environment 160 through an open retrieval valve 154.

In still other embodiments, the retrieval valve 154 may not be opened until after the subsea equipment package 100 has been disconnected from the production flow lines 103 (see, FIG. 1A) and thereafter raised from its position near the sea floor at least part of the way to the surface, i.e., to a shallower water depth and a lower hydrostatic pressure. In such embodiments, the pre-charge valve 153 may be opened after the first movable piston 140 has moved past the opening to the pre-charge line 123, and/or after pressure in the third adjustable accumulator chamber 132 has equalized with that of the subsea environment 160, thereby commencing the pressure-relieving operation, as well as the venting operation of the expanding hydrocarbon gases. In yet further exemplary embodiments, discharge of the incompressible fluid from the third adjustable accumulator chamber 132 may be gradually controlled as the subsea equipment package 100 is being raised from the sea floor, for example, by using an adjustable control valve as the retrieval valve 154. Similarly, an adjustable control valve may be used as the pre-charge valve 153, thereby allowing pressure-relieving and venting operations to be performed in a substantially controlled manner.

It should be appreciated by a person of ordinary skill having full benefit of the presently disclosed subject matter that the specific pressure-relieving and venting sequences using the accumulator device 120*e* and described above are exemplary only. Furthermore, it should also be understood that the above-described exemplary sequences are equally applicable to pressure-relieving and venting operations on a subsea equipment package 100 that includes any of the various illustrative embodiments of the accumulator device 120*d* illustrated in FIG. 1E and described herein. Moreover, it should be further appreciated that other various combinations of operational steps are well within the spirit and scope of the present disclosure, and may also be used to perform pressure-relieving and venting operations on the illustrative subsea equipment package 100 using the various described exemplary embodiments of the accumulator devices 120*d* and 120*e*.

Figure 2A:
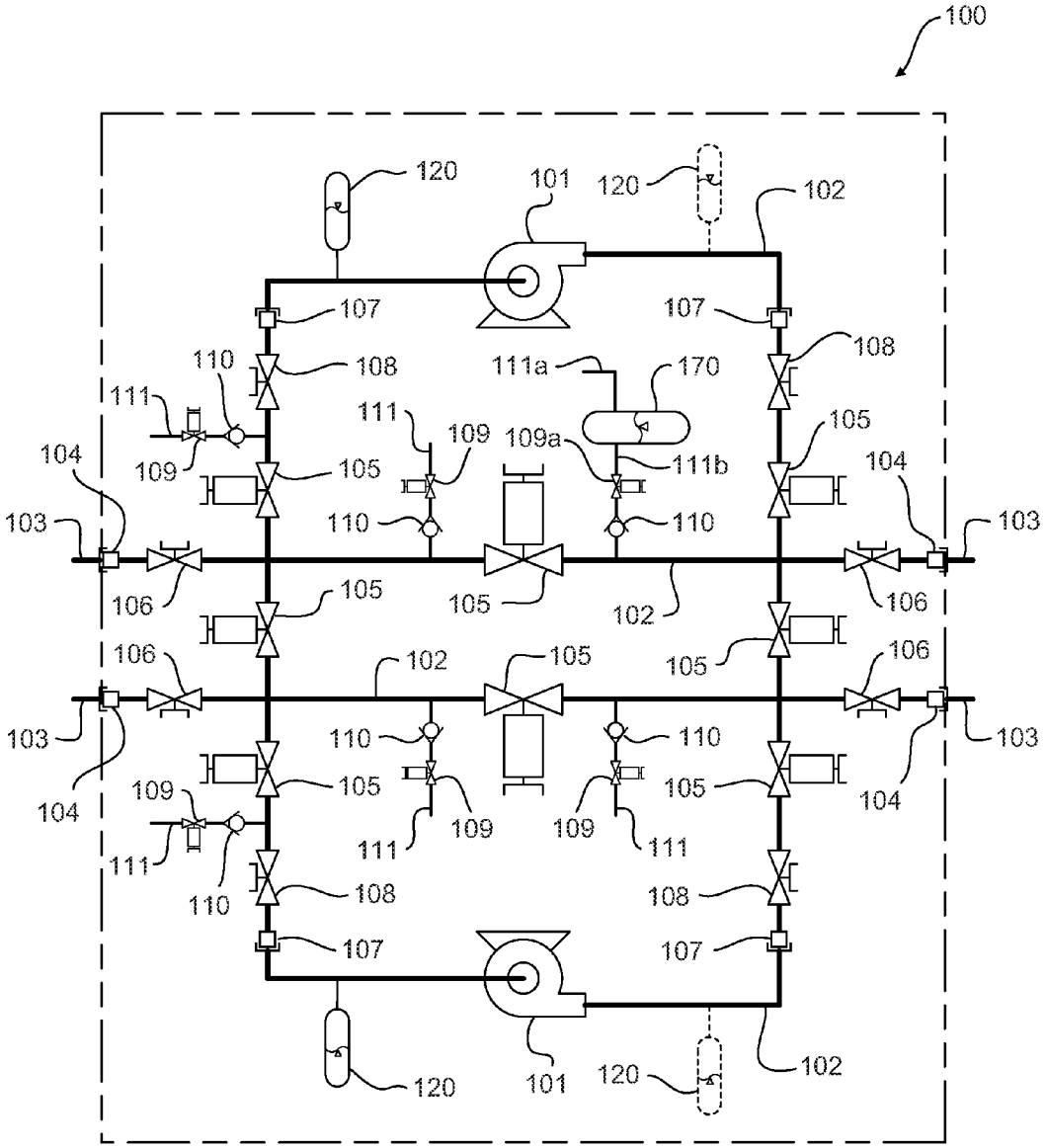
FIG. 2A is a schematic process flow diagram of an illustrative subsea equipment package in accordance with another illustrative embodiment of the present disclosure.

FIG. 2A schematically depicts a further illustrative embodiment of the subsea equipment package 100, wherein one or more accumulator devices 170 may be used to accumulate and store a quantity of one or more flow assurance chemicals, one or more material protection chemicals, or a combination thereof as may be required, and which, for simplicity, may collectively be referred to hereinafter as "equipment protection fluids." Furthermore, in at least some illustrative embodiments, the equipment protection fluids stored in the accumulator device or devices 170 may be injected into the package 100 during a stage of equipment shutdown and/or prior to equipment retrieval, as will be described in further detail below.

As shown in FIG. 2A, a chemical injection line 111*a* may be used to feed a supply of one or more appropriate equipment protection fluids to the accumulator device 170 after the subsea equipment package 100 has been deployed to its subsea location, thereby at least partially filling, or pre-charging, the accumulator device 170 with a volume of equipment protection fluids. The accumulator device 170 may be pre-charged with equipment protection fluids through the chemical injection line 111*a* from any one of several sources that may commonly be used in subsea production and/or processing operations. For example, in certain embodiments, the equipment protection fluids may be provided from a subsea chemical injection package (not shown), which may be a stand-alone package, or which may be part of a subsea Christmas tree assembly, and the like. In other embodiments, the equipment protection fluids may be provided through an umbilical line (not shown) that may be lowered from an intervention vessel at the surface. In still other embodiments, the equipment protection fluids may be provided by an ROV (not shown), which may carry a quantity of equipment protection fluids to the subsea location of the subsea equipment package 100 in a belly skid. In at least some embodiments, the flow assurance chemical may be stored in the accumulator device 170 for a period of time, after which it may be injected at an appropriate time (as further described below) into, for example, a skid flow line 102 of the subsea equipment package 100 through the chemical injection line 111*b* by operation of the chemical injection control valve 109*a*.

It should be understood that the specific location of the accumulator device 170 shown in FIG. 2A is exemplary only, as the accumulator devices 170 may be used to inject a flow assurance chemical into the illustrative subsea equipment package 100 at any appropriate location as may be required by the specific design layout and operational characteristics of the package 100. Furthermore, it should also be understood that the subsea equipment package 100 may include two or more appropriately located accumulator devices 170, each of which may be adapted to store one or more different equipment protection fluids for later injection into the package 100 via the chemical injection line 111*b* and chemical injection control valve 109*a*.

In certain embodiments, equipment protection fluids may be stored in the accumulator device 170 until such time as a specific predetermined operational phase of the subsea equipment package 100 requires that at least a portion of the equipment protection fluids be released into package 100. In some illustrative embodiments, the equipment protection fluids may be released from the accumulator device 170 and into subsea equipment package 100 upon command, whereas in other embodiments the equipment protection fluids may be released automatically based upon a predetermined condition, as will be described in further detail below.

For example, in those embodiments wherein the subsea equipment package 100 is being prepared for retrieval to the surface for repair and/or replacement, an appropriate control signal may be sent to the chemical injection control valve 109*a* instructing the valve 109*a* to release at least a portion of the equipment protection fluids from the accumulator device 170 into the package 100. Furthermore, depending on the type of equipment protection fluids being injected and the specific problems those types of equipment protection fluids are intended to address (e.g., hydrate formation, precipitate formation, wetted surface corrosion, etc.) the signal instructing the chemical injection control valve 109*a* to release the equipment protection fluids may be sent to the valve 109*a* after the subsea equipment package 100 has been shut in and isolated but before the pumps 101 have been shut down, i.e., while the pumps 101 are still circulating hydrocarbons and/or other produced liquids through the skid flow lines 102. In this way, the equipment protection fluids from the accumulator device 170 may be at least partially circulated to the various piping components, valves, and pieces of subsea equipment and the like that may be a part of the subsea equipment package 100, which may be advantageous for larger subsea equipment packages containing several hundred gallons, or even more, of produced liquid. In other embodiments, the equipment protection fluids may be released by the chemical injection control valve 109*a* after the pumps 101 have been shut down, which may be sufficient for smaller subsea equipment packages containing less than a few hundred gallons of produced liquid, and/or when the injected equipment protection fluids may be sufficiently miscible in the produced liquid to allow the equipment protection fluids to circulation substantially throughout the subsea equipment package 100 without the assistance of the pumps 101.

As noted previously, in at least some illustrative embodiments, at least a portion of the equipment protection fluids may be automatically released from the accumulator device 170 by the chemical injection control valve 109*a* upon the occurrence of a predetermined condition. For example, in certain embodiments, the chemical injection control valve 109*a* may automatically release equipment protection fluids when one or both of the pumps 101 inadvertently shut down, such as during a loss of power to the subsea equipment package 100. In this way, the equipment protection fluids that are automatically released from the accumulator device 170 by the chemical injection control valve 109*a* may at least partially protect the subsea equipment package 100 from the inadvertent detrimental effects associated with hydrate formation, precipitate formation, material corrosion, and the like. In such embodiments, the chemical injection control valve 109*a* may be, for example, a solenoid operated valve, which may closed while the solenoid control is energized, and which may open when the solenoid is de-energized, such as during those cases when power is lost to the subsea equipment package 100.

In still other embodiments, the accumulator device 170 may be adapted and operated to release equipment protection fluids into the subsea equipment package 100, either automatically or on command, during normal operation of the package 100. In such cases, the accumulator device 170 may be operated to inject flow assurance chemical either alone or in conjunction with the chemical injection operations that may be performed through the various other chemical injection lines 111 (see, FIG. 1A).

In certain illustrative embodiments disclosed herein, and depending on the specific equipment protection and/or retrieval scheme, it may be sufficient to release only a relatively small amount of equipment protection fluids from the accumulator device 170 so as to adequately protect the subsea equipment package 100 when flow through the package has been stopped. For example, depending on the types of equipment protection fluids being used and the types of problems being guarded against, the relatively small amount of equipment protection fluids that may be needed to adequately protect the subsea equipment package 100 may be a volume that is equal to no more than about 1-2% of the total volume of produced liquid that may be contained within the shut-in and isolated package 100, as may be the case when the equipment protection fluids may be a flow assurance chemicals, such as low dosage hydrate inhibitors and the like. In such cases, the accumulator device 170 may be sized to hold no more than a single pre-charged dose of equipment protection fluids, in which case the accumulator device 170 must once again be pre-charged after an operation wherein the single dose is injected into the subsea equipment package 100. In some embodiments, however, the accumulator device 170 may be sized to hold a volume that is equal to two or more doses of equipment protection fluids, in which case the accumulator device 170 may not need to be pre-charged prior to each injection operation.

In other illustrative embodiments, it may be desirable to inject a larger volume of equipment protection fluids into the subsea equipment package 100 in order to adequately protect the package from the detrimental effects noted above. For example, it may be desirable to replace a substantial portion of the hydrocarbons and/or other produced fluids that may be contained within the subsea equipment package 100 by sweeping a large volume equipment protection fluids throughout the entire package 100. In operation, the equipment protection fluids may be injected into the subsea equipment package 100 from the accumulator device 170 in such a manner that the equipment protection fluids sweep away and substantially replace a large portion of the volume of liquid hydrocarbons and/or other produced fluids. It should be understood, however, that the sweeping operation described herein may not necessarily displace substantially all of the liquid hydrocarbons present in the subsea equipment package 100, as may sometimes be expected during a flushing and/or purging operation, since it may be difficult for the equipment protection fluids to reach all internal areas of equipment during a single sweeping operation. Accordingly, in certain embodiments, the sweeping operation may require a volume of equipment protection fluids that is at least equal to the total volume of the subsea equipment package 100, and in some embodiments may be up to twice the volume of the package 100. Furthermore, the above-described sweeping operation may displace up to approximately 90% or even more of the volume hydrocarbons and/or other produced fluids with the equipment protection fluids that are injected from the accumulator device 170.

In still other embodiments, it may also be desirable to remove a large portion of the hydrocarbons from the subsea equipment package 100 prior to retrieving the package 100 to the surface. In such embodiments, it may therefore be possible to retrieve the subsea equipment package 100 to the surface without having to vent any expanding gaseous hydrocarbons during the retrieval process (see, for example, FIGS. 1E-1G, described above), since there may be very little if any hydrocarbons present in the package 100 before it is raised from its position near the sea floor. In some embodiments, it may be sufficient to sweep the hydrocarbons out of the subsea equipment package by injecting equipment protection fluids from the accumulator device 170 in the manner previously described. In other embodiments, a sweeping liquid having a higher viscosity than the liquid hydrocarbons, and/or which may be substantially immiscible in the liquid hydrocarbons, may be stored in the accumulator device 170 and used to sweep the liquid hydrocarbons out of the subsea equipment package 100. In certain embodiments, the sweeping liquid may be, for example, a gelled liquid, such as gelled diesel oil or gelled MEG and the like. Other sweeping liquids may also be used, provided they are capable of sweeping a substantial amount of the liquid hydrocarbons and/or other produced fluids out of the subsea equipment package 100.

Figure 2B:
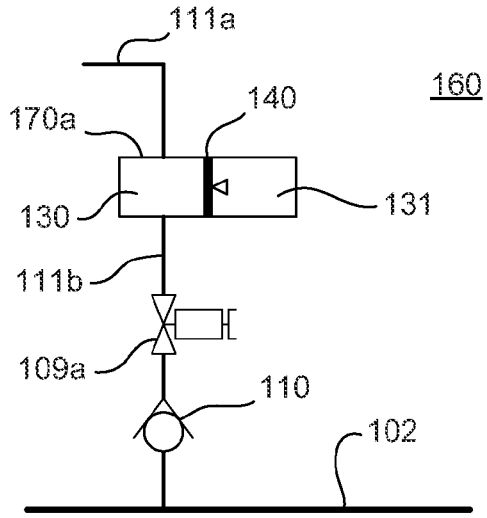
FIGS. 2B and 2C are schematic process flow diagrams of exemplary accumulator devices that may be used in conjunction with the subsea equipment package of FIG. 2A in accordance with other illustrative embodiments disclosed herein.

FIG. 2B schematically illustrates an exemplary accumulator device 170*a* that may be representative of at least some embodiments of the accumulator device 170 shown in FIG. 2A. In certain embodiments, the illustrative accumulator device 170*a* may be configured in a substantially similar fashion to the accumulator device 120*a* shown in FIG. 1B, in which first and second adjustable accumulator chamber 130 and 131 are separated by a movable piston 140. In some embodiments, the second adjustable accumulator chamber 131 may be pre-charged with a gas or compressible liquid, as previous described with respect to FIG. 1B, which may be pre-charged prior to deployment of the subsea equipment package 100 to its subsea location. Furthermore, and depending on the various system design parameters, such as operating pressure of the subsea equipment package 100, the hydrostatic pressure of the subsea environment 160 (i.e., the water depth), and the operating pressure of the chemical injection line 111*a* and the first adjustable accumulator chamber 130 (i.e., the delivery pressure of the equipment protection fluids), the gas pre-charge pressure in the second adjustable accumulator chamber 131 may be adjusted as necessary to control the amount of equipment protection fluids that may be stored in the first adjustable accumulator chamber 130. Furthermore, the gas pre-charge pressure may be further adjusted so as to adjust the injection pressure of the equipment protection fluids, thereby substantially assuring that the equipment protection fluids can be injected from accumulator device 170*a* into the skid flow lines 102 as required.

In other illustrative embodiments, the accumulator device 170*a* may be configured in a substantially similar manner to either of the accumulator devices 120*b* or 120*c* as shown in FIGS. 1C and 1D, respectively. Using either of these configurations, the second adjustable accumulator chamber of the accumulator device 170*a* may be biased directly to the hydrostatic pressure of the subsea environment 160, which may be used to control the quantity of equipment protection fluids that are stored in the first adjustable accumulator chamber 130. Furthermore, a biasing spring 150 may also be used as previously described, thereby enabling an additional degree of adjustment of the pressure that is exerted on the movable piston 140 by the second adjustable chamber 131, which may again control the amount of equipment protection fluids that may be stored in the first adjustable accumulator chamber 130.

Figure 2C:
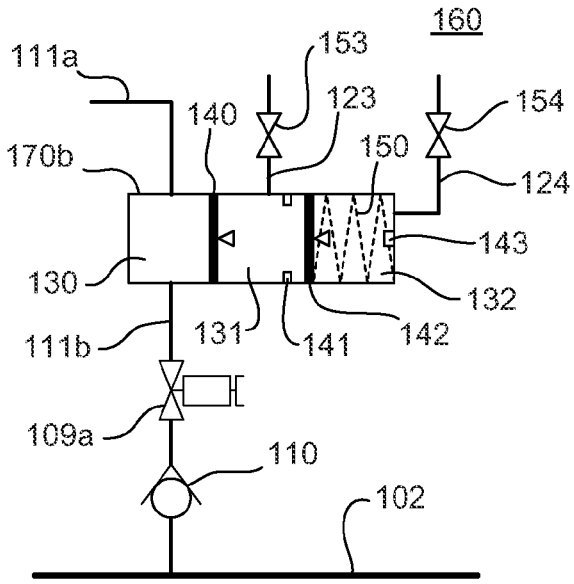

FIG. 2C schematically depicts an illustrative accumulator device 170*b* that may be representative of further exemplary embodiments of the accumulator device 170 shown in FIG. 2A. As shown in FIG. 2C, the accumulator device 170*b* may be configured in a substantially similar fashion as the accumulator device 120*e* illustrated in FIGS. 1F and 1G and described above. For example, the accumulator device 170*b* may include, among other things, first, second and third adjustable accumulator chambers 130, 131 and 132, wherein the first and second adjustable accumulator chambers 130 and 131 are separated by a first movable piston 140, and wherein the second and third adjustable accumulator chambers 131 and 132 are separated by a second movable piston 141. In some embodiments, the pre-charge fluids in the second and third adjustable accumulator chambers 131 and 132 may be as previously described with respect to the accumulator device 120*e* above. Furthermore, the pre-charge pressures in the second and third adjustable accumulator chambers 131 and 132 may be adjusted as described with respect to the accumulator device 170*a* above so as to control the quantity of equipment protection fluids that may be stored in the first adjustable accumulator chamber 130 of the accumulator device 170*b*. Additionally, the pre-charge pressures may be further adjusted and the operation of the pre-charge valves 153 and 154 controlled in such a manner as to adjust the injection pressure of the equipment protection fluids, thereby substantially assuring that the equipment protection fluids can be injected from the accumulator device 170*b* into the skid flow lines 102.

As a result of the above-described subject matter, various illustrative systems and methods are disclosed which may be used to facilitate the retrieval and/or replacement of oil and gas production and/or processing equipment from a subsea environment. In certain embodiments, the disclosed systems and methods may include, among other things, an accumulator device that is in fluid communication with the subsea equipment as it is being retrieved, and which may have a pressure boundary that is adapted to move in response to a pressure change on the subsea equipment as it is being raised from a subsea environment. Also disclosed are systems and methods that may be used to substantially protect subsea equipment during equipment shutdowns, such as by utilizing an accumulator device to accumulate and store a quantity of equipment protection fluids while positioned in a subsea environment, and injecting at least a portion of the equipment protect fluids into the subsea equipment as may be required.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A system, comprising:

subsea equipment that is adapted to contain a first fluid while operating in a subsea environment, wherein said first fluid is a produced fluid comprising produced hydrocarbons; and an accumulator device that is in fluid communication with said subsea equipment, wherein said accumulator device comprises a first adjustable accumulator chamber, a second adjustable accumulator chamber, and a pressure boundary that is adapted to move in response to a change in hydrostatic pressure exerted on said subsea equipment by said subsea environment as said subsea equipment is raised from said subsea environment and wherein said first adjustable accumulator chamber is adapted to receive at least a portion of said first fluid.

2. The system of claim 1, wherein said pressure boundary is further adapted to move in response to a change in a fluid pressure of said first fluid.

3. The system of claim 1, wherein said second adjustable accumulator chamber is adapted to contain a second fluid.

4. The system of claim 3, wherein said second adjustable accumulator chamber is adapted to be in fluid communication with said subsea environment and said second fluid comprises seawater.

5. The system of claim 1, wherein said pressure boundary comprises a movable piston that is positioned between said first adjustable accumulator chamber and said second adjustable accumulator chamber.

6. The system of claim 5, wherein movement of said movable piston in response to said pressure change adjusts a size of at least one of said first and second adjustable accumulator chambers.

7. The system of claim 5, wherein said accumulator device comprises a biasing spring positioned in said second adjustable accumulator chamber, said biasing spring being adapted to control movement of said movable piston.

8. The system of claim 1, wherein said accumulator device comprises a valve that is positioned to be in fluid communication with at least one of said first and second adjustable accumulator chambers, said valve being adapted to reduce a fluid pressure of said first fluid in response to said pressure change.

9. The system of claim 8, wherein said valve is adapted to vent an expanding gas that is released from said first fluid in response to said pressure change into said subsea environment.

10. The system of claim 1, wherein said accumulator device comprises a third adjustable accumulator chamber, said first and second adjustable accumulator chambers being separated by a first movable piston and said second and third adjustable accumulator chambers being separated by a second movable piston that is independently movable relative to said first movable piston, wherein movement of said first movable piston adjusts a size of at least one of said first and second adjustable accumulator chambers and wherein movement of said second movable piston adjusts a size of at least one of said second and third adjustable accumulator chambers.

11. The system of claim 10, wherein said second adjustable accumulator chamber is adapted to contain a second fluid and said third adjustable accumulator chamber is adapted to contain a third fluid, said second fluid comprising a compressible fluid and said third fluid comprising a substantially incompressible liquid.

12. The system of claim 11, wherein said accumulator device comprises a first valve and a second valve, said first valve being adapted to vent an expanding gas that is released from said first fluid into said subsea environment in response to said pressure change and said second valve being in fluid communication with said third adjustable accumulator chamber.

13. The system of claim 12, wherein said second valve is adapted to control movement of at least one of said first and second movable pistons by releasing at least a portion of said third fluid into said subsea environment.

14. The system of claim 13, wherein said first movable piston is adapted to move from at least a first piston position to a second piston position, said first valve being positioned to be in fluid communication with said second adjustable accumulator chamber when said first movable piston is in said first piston position and in fluid communication with said first adjustable accumulator chamber when said movable piston is in said second piston position.

15. The system of claim 10, wherein said accumulator device comprises a biasing spring positioned in said third adjustable accumulator chamber, said biasing spring being adapted to control movement of said second movable piston.

16. The system of claim 1, further comprising a second accumulator device, wherein said second accumulator device is adapted to receive and store a quantity of equipment protection fluids, and to controllably inject at least a portion of said stored quantity of equipment protection fluids into said subsea equipment.

17. The system of claim 1, wherein said subsea equipment is adapted to be coupled to a subsea production line and to receive said produced fluid comprising said produced hydrocarbons from said subsea production line.

18. A system, comprising:

subsea equipment that is adapted to contain a first fluid at a first fluid pressure while operating in a subsea environment, wherein said first fluid is a produced fluid comprising produced hydrocarbons;

an accumulator device that is adapted to adjust to a change in hydrostatic pressure exerted on said subsea equipment by said subsea environment as said subsea equipment is raised from said subsea environment, said accumulator device comprising:

a first adjustable accumulator chamber that is in fluid communication with said subsea equipment and is adapted to receive at least a portion of said first fluid;

a second adjustable accumulator chamber that is adapted to contain a second fluid; and a first movable piston positioned between said first adjustable accumulator chamber and said second adjustable accumulator chamber, said first movable piston being adapted to move in response to said change in said hydrostatic pressure exerted on said subsea equipment as said subsea equipment is raised from said subsea environment, said movement adjusting a size of at least one of said first and second adjustable accumulator chambers; and a first valve that is positioned to be in fluid communication with at least one of said first and second adjustable accumulator chambers, said first valve being adapted to reduce said first fluid pressure in response to said pressure change.

19. The system of claim 18, wherein said first movable piston is adapted to move in response to at least one of a change in a fluid pressure of said first fluid and a change in a fluid pressure of said second fluid.

20. The system of claim 18, wherein said second adjustable accumulator chamber is adapted to be biased to said subsea environment and said second fluid is seawater.

21. The system of claim 18, wherein said accumulator device comprises a third adjustable accumulator chamber that is separated from said second adjustable accumulator chamber by a second movable piston that is independently movable relative to said first movable piston.

22. The system of claim 21, wherein said accumulator device comprises a second valve that is in fluid communication with said third adjustable accumulator chamber, said second valve being operable to releasing at least a portion of said third fluid into said subsea environment, wherein said operation of said second valve controls a movement of at least one of said first and second movable pistons.

23. The system of claim 18, wherein said subsea equipment is adapted to be coupled to a subsea production line and to receive said produced fluid comprising said produced hydrocarbons from said subsea production line.

24. A system, comprising:

subsea equipment that is adapted to contain a first fluid while operating in a subsea environment, wherein said first fluid is a produced fluid comprising produced hydrocarbons;

an accumulator device, comprising:

a first adjustable accumulator chamber that is adapted to receive and store a quantity of a second fluid while said subsea equipment is positioned in said subsea environment; and a second adjustable accumulator chamber that is adapted to contain a third fluid and to be in fluid communication with said subsea environment, said third fluid comprising seawater; and a valve that is adapted to controllably inject at least a portion of said quantity of said second fluid stored in said first adjustable accumulator chamber of said accumulator device into said subsea equipment.

25. The system of claim 24, wherein said valve is adapted to inject said at least said portion of said quantity of stored second fluid into said subsea equipment prior to raising said subsea equipment from said subsea environment.

26. The system of claim 24, wherein said valve is adapted to inject said at least said portion of said quantity of stored second fluid into said subsea equipment automatically under a pre-determined condition.

27. The system of claim 24, wherein said second fluid comprises at least one equipment protection fluid.

28. The system of claim 27, wherein said at least one equipment protection fluid comprises at least one of at least one flow assurance chemical and at least one material protection chemical.

29. The system of claim 24, wherein said second fluid comprises a gelled fluid.

30. The system of claim 24, wherein said accumulator device comprises a first movable piston positioned between said first adjustable accumulator chamber and said second adjustable accumulator chamber, wherein movement of said first movable piston adjusts a size of at least one of said first and second adjustable accumulator chambers.

31. The system of claim 24, wherein said subsea equipment is adapted to be coupled to a subsea production line and to receive said produced fluid comprising said produced hydrocarbons from said subsea production line.

32. A system, comprising:

subsea equipment that is adapted to contain a first fluid while operating in a subsea environment, wherein said first fluid is a produced fluid comprising produced hydrocarbons; and an accumulator device that is in fluid communication with said subsea equipment, wherein said accumulator device comprises a first adjustable accumulator chamber that is adapted to receive at least a portion of said first fluid, a second adjustable accumulator chamber that is adapted to be in fluid communication with said subsea environment and to contain a second fluid comprising seawater, and a pressure boundary that is adapted to move in response to a pressure change on said subsea equipment as said subsea equipment is raised from said subsea environment.

33. A system, comprising:

subsea equipment that is adapted to contain a first fluid while operating in a subsea environment, wherein said first fluid is a produced fluid comprising produced hydrocarbons; and an accumulator device that is in fluid communication with said subsea equipment, said accumulator device comprising:

a first adjustable accumulator chamber that is adapted to receive at least a portion of said first fluid;

a second adjustable accumulator chamber;

a first movable piston separating said first and second adjustable accumulator chambers, wherein movement of said first movable piston adjusts a size of at least one of said first and second adjustable accumulator chambers;

a third adjustable accumulator chamber; and a second movable piston separating said second and third adjustable accumulator chambers, wherein movement of said second movable piston adjusts a size of at least one of said second and third adjustable accumulator chambers, at least one of said first and second movable pistons comprising a pressure boundary that is adapted to move in response to a pressure change on said subsea equipment as said subsea equipment is raised from said subsea environment.

* * * * *